United States Patent [19]

Amouroux et al.

[11] Patent Number: 5,026,949

[45] Date of Patent: Jun. 25, 1991

[54] METHOD OF CRACKING A BATCH OF HEAVY HYDROCARBONS INTO LIGHTER HYDROCARBONS

[75] Inventors: Jacques Amouroux, Bures Sur Yvette; Mehrdad Nikravech, Paris; Jacques Saint-Just, Le Pecq; Isabelle Vedrenne, Paris, all of France

[73] Assignee: Gaz de France, Paris, France

[21] Appl. No.: 440,300

[22] Filed: Nov. 22, 1989

[30] Foreign Application Priority Data

Nov. 24, 1988 [FR] France ..... 88 15363

[51] Int. Cl.[5] ..... C07C 4/02

[52] U.S. Cl. ..... 585/648; 585/650; 585/651; 585/653

[58] Field of Search ..... 585/648, 650, 651, 653

[56] References Cited

FOREIGN PATENT DOCUMENTS 0120625 10/1984 European Pat. Off. .

0292391 11/1988 European Pat. Off. .

0316234 5/1989 European Pat. Off. .

*Primary Examiner*—Curtis R. Davis

*Attorney, Agent, or Firm*—Kenyon & Kenyon

[57] ABSTRACT

A method of cracking heavy hydrocarbons into lighter hydrocarbons consisting in providing an advantageously catalytic bed of particles in a reaction chamber, feeding a bed fluidizing gas with a predetermined flow rate to provide a springing fluidized bed and feeding a plasma jet preferably containing argon into the chamber, the jet being directed towards a determined place of the bed so as to provide a reaction space with at least two reaction zones of different temperatures, the zone of higher temperature being the one where the plasma jet is directed; feeding heavy hydrocarbons into the reaction zone of lower temperature and feeding preferably in the zone of higher temperature at least one light alkane for carrying out the cracking of the heavy hydrocarbons within the fluidized bed, the latter effecting a quenching of the reaction medium and catalysing the cracking and consisting in discharging the products obtained downstream of the zone of lower temperature.

22 Claims, 2 Drawing Sheets

7
6
1
4
2
8
5
9
3
11

METHOD OF CRACKING A BATCH OF HEAVY HYDROCARBONS INTO LIGHTER HYDROCARBONS

BACKGROUND OF THE INVENTION

The present invention relates to a method of cracking heavy hydrocarbons into lighter hydrocarbons and a device for carrying out this method.

The invention is in particular applicable in the chemical and power generating industries.

There presently exist several types of cracking methods such as the thermal cracking, the hydrocracking and the catalytic cracking. These methods however exhibit all the inconveniences tied to the difficulty of controlling the reaction, to the excessive consumption of hydrogen and to the necessity of a frequent regeneration of the catalysts.

There is also known from the European patent application publication No. 0 120 625 a method of cracking heavy hydrocarbons into lighter hydrocarbons. The process according to this document exhibits the drawback of requiring a high temperature zone for the formation of free radicals generating species which would participate in the cracking reaction and a zone mechanically separated from the former one and of a lower temperature for the cracking reaction proper.

Therefore the object of the present invention is to provide a method of cracking heavy hydrocarbons into lighter hydrocarbons which does not exhibit the inconveniences of the prior art and which moreover makes it possible to obtain a higher selectivity in light hydrocarbons and better output efficiencies or yields.

SUMMARY OF THE INVENTION

For that purpose the method according to the present invention consists in the steps of creating within a reaction chamber an advantageously catalytic bed of particles fluidized by a fluidizing gaseous stream and of feeding a plasma jet preferably containing argon into the reaction chamber, the jet being directed towards a determined portion of the bed so as to provide a zone of high temperature constituting the reaction zone of higher temperature; of inserting a batch of heavy hydrocarbons at a place of the fluidized bed remote from the plasma jet to obtain the reaction zone of lower temperature and of inserting into the zone of higher temperature a light alkane such as methane or a mixture of light alkanes for performing the cracking of said heavy hydrocarbons within the fluidized bed, the latter effecting a quenching of the reaction medium and catalysing the cracking; and of discharging the lighter hydrocarbons thus obtained downstream of the zone of lower temperature.

According to other characterizing features of the method of the invention:

The plasma is introduced at the periphery of the fluidized bed;

A determined residence time is imposed to the products obtained within a zone downstream of that with a lower temperature;

The flow rate of the fluidizing gaseous stream is determined to provide a springing fluidized bed;

The fluidizing gaseous stream comprises at least argon and/or hydrogen;

The plasma contains at least 80% by volume of argon and may in addition contain hydrogen;

The plasma and the heavy hydrocarbons are introduced on either side of the springing fluidized bed;

The reaction zone of higher temperature is at a temperature lying between about 5,000° C. and 1,000° C.;

The zone of lower temperature is at a temperature lying between about 900° C. and 500° C.;

The methane is fed into the reaction zone the temperature of which is lying between about 5,000° C. and 1,000° C.;

The batch of heavy hydrocarbons is fed into the springing fluidized bed within the reaction zone the temperature of which is comprised between about 900° C. and 500° C.

The fluidizing gas is preheated upstream of the fluidized bed to a temperature lying between 50° C. and 500° C., preferably between 150° C. and 350° C.;

The batch of heavy hydrocarbons is preheated and vaporized in the reaction chamber;

The bed consists of particles of a refractory material selected in particular from the group consisting of oxides, carbides, nitrides and borides;

The bed particles have a catalytic effect;

The bed in addition contains a catalyst;

The cracking reaction is continued downstream of the zone of lower temperature of the fluidized bed within a zone exhibiting a temperature lying between about 650° C. and 550° C.

The present invention is also directed to a device for performing the above-mentioned method, this device comprising a reaction chamber 1 including a bed of particles 2, means for injecting a gaseous stream 3 for fluidizing the bed and located at the level of the bottom of the chamber to provide a springing fluidized bed, a torch 6 operating with a plasma preferably containing argon and adapted to inject the plasma into the reaction chamber towards the fluidized bed for creating at least two reaction zones of differing temperatures and determining a reaction zone of higher temperature and a zone of lower temperature, means 4 for introducing a batch of heavy hydrocarbons, located at the level of the reaction zone of lower temperature, means 5 for feeding a light alkane such as methane or a mixture of light alkanes into the zone of higher temperature and means 7 adapted to continue the cracking reaction and to discharge the lighter hydrocarbons thus obtained.

According to further characterizing features of the device of the invention:

The plasma torch 6 and the means for introducing heavy hydrocarbons 4 are arranged on either side of the springing fluidized bed;

The means for introducing the batch of heavy hydrocarbons consist of an injection pipe or the like;

The means for introducing the light alkane such as methane or the mixture of light alkanes consist of an injection pipe or the like;

The means 7 for continuing the cracking reaction and for discharging the hydrocarbons obtained consist for instance of a tubular reactor;

The reaction chamber has a cylindrical, parallelepipedic, spherical or like shape;

The plasma torch is connected preferably at the level of a side wall of the chamber so that the plasma be injected laterally into the fluidized bed;

The walls of the reaction chamber are made preferably from a refractory material such as alumina;

The bottom 8 of the reaction chamber has an upward flared shape at the lower portion of which are opening means 9 for injecting the fluidizing gas.

BRIEF DESCRIPTION OF THE DRAWINGS

The invention will be better understood and further objects, characterizing features, details and advantages thereof will appear more clearly as the following explanatory description proceeds with reference to the accompanying diagrammatic drawings given by way of non limiting examples only and wherein.

DETAILED DESCRIPTION OF THE INVENTION

Figure 1:
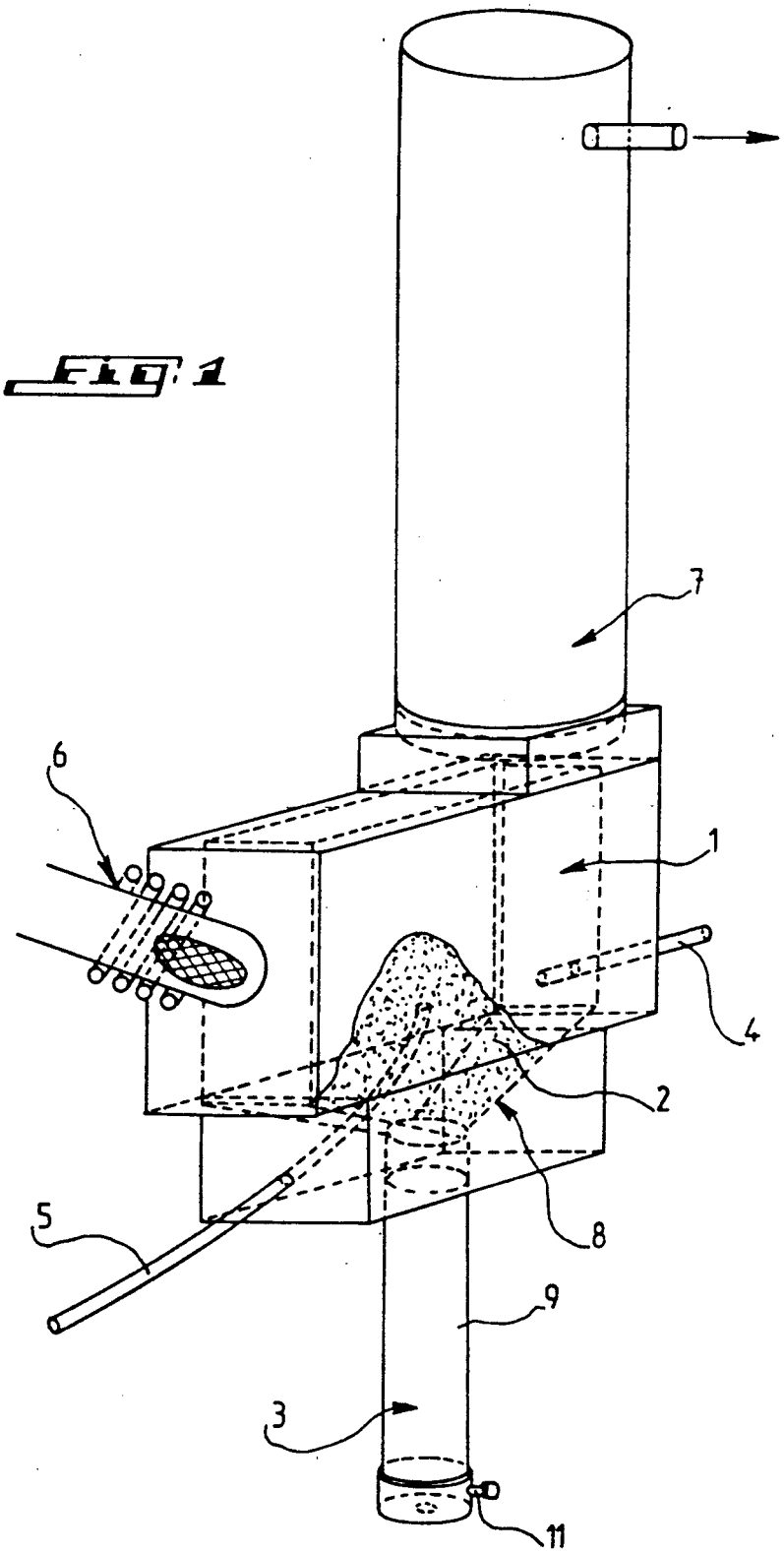
FIG. 1 shows a presently preferred embodiment of the method and of the device according to the invention.

The method according to the invention is carried out by means of a device of the kind shown in FIG. 1 and comprising a reaction chamber exhibiting for instance the general shape of a rectangular parallelepiped the bottom 8 of which has an upwards flared shape connected at its lower portion to means 3 for injecting a fluidizing gaseous stream, and containing a body of particles of a material adapted to form or to build up a fluidized bed 2, and a torch 6 operating with a plasma of a gas preferably containing argon and adapted to feed the plasma inside of the reaction chamber and towards the fluidized bed of particles. Preferably the plasma torch 6 is connected at a side wall of the reaction chamber so that the plasma can be fed laterally into the fluidized bed.

A preferably tubular reactor 7 is connected to the upper portion of the reaction chamber 1 so that the reactor 7 communicates with the inside of the reaction chamber.

Means 4 for introducing the batch of heavy hydrocarbons are provided and connected to a wall of the reaction chamber 1 so that the heavy hydrocarbons can be caused to contact the fluidized bed in a zone of the reaction chamber having a determined temperature lying between about 900° C. and 500° C. The injection means 4 may in particular comprise an injection pipe or the like.

Means 5 for injecting a light alkane such as methane or a mixture of light alkanes are provided and connected at the lower portion of the reaction chamber 1 so as to feed methane into the fluidized bed at a zone of high temperature lying between about 5,000° C. and 1,000° C. in the reaction chamber 1. These introduction means 5 may consist of an injection pipe or the like.

The reaction chamber 1 has inner walls made for instance from 4 mm thick refractory alumina and is thermally insulated outside by a layer of porous bricks of 20 mm in thickness adhesively bonded or stuck by a refractory cement onto the alumina. The layer of bricks is itself covered with a layer of glass wool with a thickness of about 14 mm wrapped in a layer of asbestos. Thermocouples (not shown) are arranged within the reaction chamber for measuring the temperatures of the fluidized bed.

Means 3 for injecting the fluidizing gaseous stream comprise for instance an opaque silica tube 9 of a length of about 300 mm and of a diameter of about 40 mm opening in the bottom of the reaction chamber 1. The tube is surrounded by a 500 W heating tape or strip (not shown) adapted to preheat the fluidizing gas and it is fitted with refractory balls of a diameter of about 2 mm to 6 mm promoting the heat exchanges between the gas and the wall of the tube. The lower part of the tube 9 is fitted with a brass injector 11.

The tubular reactor 7 consists for instance of a silica tube having a diameter of about 85 mm and a length of about 500 mm. Thermocouples (not shown) are arranged within this tube for measuring the temperature of the gaseous stream flowing therein. The outlet of this tube may be connected to a water heat exchanger (not shown) in which the reaction mixture is cooled before being taken off for analysis purposes.

The plasma torch and the means for introducing the heavy hydrocarbons are connected at the reaction chamber so that the plasma and the heavy hydrocarbons can be inserted on either side of the fluidized bed on the side opposite to the plasma torch with respect to the jet of particles of the bed. It is possible to vary the angle of insertion of the torch into the chamber from 0° to 90° . Preferably the angle of insertion of the torch into the chamber is 20° with respect to the horizontal section of the reaction chamber. Typically this torch consists of two concentric silica tubes having an outer diameter of 30 mm and surrounded by five water-cooled hollow inductive copper turns through which a high frequency electric current is flowing.

The bed consists of particles of a material selected in particular from the group consisting of oxides, carbides, nitrides and borides. The following list of materials may be given as an illustrative example:

| | |
|---|---|
| Oxides | |
| of aluminum | $Al_2O_3$ |
| of magnesium | MgO |
| of calcium | CaO |
| of beryllium | BeO |
| of cerium | CeO |
| of thorium | $ThO_2$ |
| of hafnium | $HfO_2$ |
| of lanthanum | $La_2O_3$ |
| and other mixed oxides. | |
| carbides | |
| of silicon | SiC |
| of thorium | ThC |
| of boron | $B_4C$ |
| nitrides | |
| of boron | BN |
| of hafnium | HfN |
| of zirconium | ZrN |
| borides | |
| of thorium | $ThB_4$ |
| of niobium | $NbB_2$ |
| of zirconium | $ZrB_2$ |
| carbon (graphite) | C |

Whatever the nature of the materials used, they should be refractory since the particles of the bed have to be capable of withstanding high temperatures because they are in contact with the plasma jet. The particles of the bed may themselves play the function of a catalyst and it is also possible to add another catalyst thereto. The particles of the fluidized bed have a diameter lying between about 250μ and 400μ. The selected granulometry should make it possible to provide a springing fluidization without the carrying the particles along and out of the reaction chamber 1.

It should be understood that the word "catalyst" is taken in its broad meaning, i.e. the particles may accelerate certain desired reactions or inhibit certain undesired reactions such as the formation of carbon black or coke.

When working the operation of the device just described is the following. The body of particles of a determined diameter which may contain a catalyst is caused to be fluidized into a springing bed exhibiting the shape of a spring falling down onto the walls of the reaction chamber, by the constant flow rate of a fluidizing gas consisting of argon or of a mixture or argon and hydrogen. The fluidizing gas is preheated in the tube 9 which is fitted or lined with balls made for instance from alumina.

The plasma torch 6 injects a plasma of a gas preferably containing argon towards the fluidized bed of particles where there is effected an effective heat transfer between the plasma and the fluidized bed.

The injection pipe 5 would inject for instance methane inside of the fluidized bed into a zone adjacent to that of the injection of plasma and exhibiting a temperature lying between about 5,000° C. and 1,000° C. Within this zone of relatively high temperature the methane will break down in the following manner:

$$CH_4 \rightarrow CH_3 \cdot + H \cdot$$

$$CH_3 \rightarrow CH_2 \cdot + H \cdot$$

etc . . .

Thus within this zone of relatively high temperature radicals promoting the reaction of cracking heavy hydrocarbons are generated.

The pipe 4 for injecting heavy hydrocarbons allows them to be fed into the fluidized bed within a determined region having a temperature lying between about 900° C. and 500° C. and located approximately opposite to the plasma injection zone.

The nature of the bed, the flow rate of the fluidizing gaseous stream and the insertion of the plasma torch into a region opposite to that of the introduction of the heavy hydrocarbons make it possible to provide a reaction space having at least said two zones of differing temperatures.

Thus within the zone of the highest temperature the methane would be converted as previously described inside of the fluidized bed. The radicals thus formed would flow through the fluidized bed towards the zone of lower temperature at which the batch of heavy hydrocarbons is fed in and would initiate the reaction for cracking the latter.

The advantage of prime importance of this kind of device consists in that it allows one to directly use methane to promote the cracking and for this purpose the device has a reaction space with two zones of different temperatures through the agency of the jet of particles which allow the reaction space to be separated from these two zones.

The use of a fluidized bed of this kind in the method according to the present invention offers substantial advantages for the following reasons:

its heat transfer properties make possible an effective quenching of the plasma;

its viscosity substantially equal to that of the plasma provides for a very good mixing between the plasma and the fluidized bed; and its possible catalytic properties may provide for the direct transformation of the reactants to be converted.

Thus the methane would be converted within the fluidized bed in a region adjacent to the plasma injection and wherein the quenching performed by the fluidized bed would allow one to have a temperature favorable to the conversion of methane into radicals. These radicals originating from the zone of higher temperature would promote the reaction of cracking the heavy hydrocarbons at a lower temperature than that of the zone of higher temperature while avoiding the formation of carbon black.

The reaction converting the heavy hydrocarbons into lighter hydrocarbons will continue within a zone located downstream of the zone of lower temperature of the fluidized bed. There will in fact be created a gradient of temperatures from the region downstream of the fluidized bed towards the tubular reactor 7, varying from about 650° C. to 550° C. and thereby allowing to complete the cracking reaction.

The following examples illustrate the performance of the method according to the invention.

In these examples an aliphatic $C_{16}$-hydrocarbon has been treated at a flow rate of about 14 to 25 g/minute for effecting the cracking reaction and the products have been analysed through chromatography by means of a flame ionization detector fitted with a 10% SE 30 column for the separation of the liquid hydrocarbons and with a 7% squalane column for the separation of the gases and light hydrocarbons.

EXAMPLE 1

The plasma torch operates at a frequency of 5 MHz for an actual power of 2.38 kW. The introduced plasma-producing gases are argon with a flow rate of 27 l/mn and hydrogen with a flow rate of 6 l/mn. The bed consists of alumina particles (650 g) with a mean diameter of 300μ. The bed particles are caused to be fluidized by a mixture of argon with a flow rate of 10 l/mn and of hydrogen with a flow rate of 14 l/mn. The fluidizing gases are preheated to a temperature lying between 50° C. and 500° C., preferably between 150° C. and 350° C. The average cracking temperature is 727° C. Methane is introduced with a flow rate of 1 l/mn.

EXAMPLE 2

The plasma torch operates at a frequency of 5 MHz for an actual power of 2.52 kW. The injection angle is 20°. The introduced plasma-producing gases are argon with a flow rate of 27 l/mn and hydrogen with a flow rate of 6 l/mn. The bed consists of alumina particles (650 g) with a mean diameter of 300μ. The bed particles are caused to be fluidized by a mixture of argon with a flow rate of 10 l/mn and of hydrogen with a flow rate of 14 l/mn. The fluidizing gases are preheated to a temperature lying between 50° C. and 500° C., preferably between 150° C. and 350° C. The average cracking temperature is 725° C. The methane is introduced with a flow rate of 0.15 l/mn.

EXAMPLE 3

The plasma torch operates at a frequency of 5 MHz for an actual power of 2.45 kW. The injection angle is 20°. The introduced plasma-producing gases are argon with a flow rate of 27 l/mn and hydrogen with a flow rate of 6 l/mn. The bed consists of alumina particles (650 g) with a means diameter of 300μ. The particles of the bed are caused to be fluidized by a mixture of argon with a with a flow rate of 10 l/mn and of hydrogen with a flow rate of 14 l/mn. The fluidizing gases are preheated to a temperature lying between 50° C. and 500° C., preferably between 150° C. and 350° C. The average cracking temperature is 725° C. The methane is introduced with a flow rate of 0.15 l/mn.

EXAMPLE 4

The plasma torch operates at a frequency of 5 MHz for an actual power of 2.45 kW. The injection angle is 20°. The introduced plasma-producing gases are argon with a flow rate of 27 l/mn and hydrogen with a flow rate of 6 l/mn. The bed consists of alumina particles (650 g) with a mean diameter of 300μ. The bed particles are caused to be fluidized by a mixture of argon with a flow rate of 10 l/mn and of hydrogen with a flow rate of 14 l/mn. The fluidizing gases are preheated to a temperature lying between 50° C. and 500° C., preferably between 150° C. and 300° C. The average cracking temperature is 720° C. No methane is injected.

Figure 2:
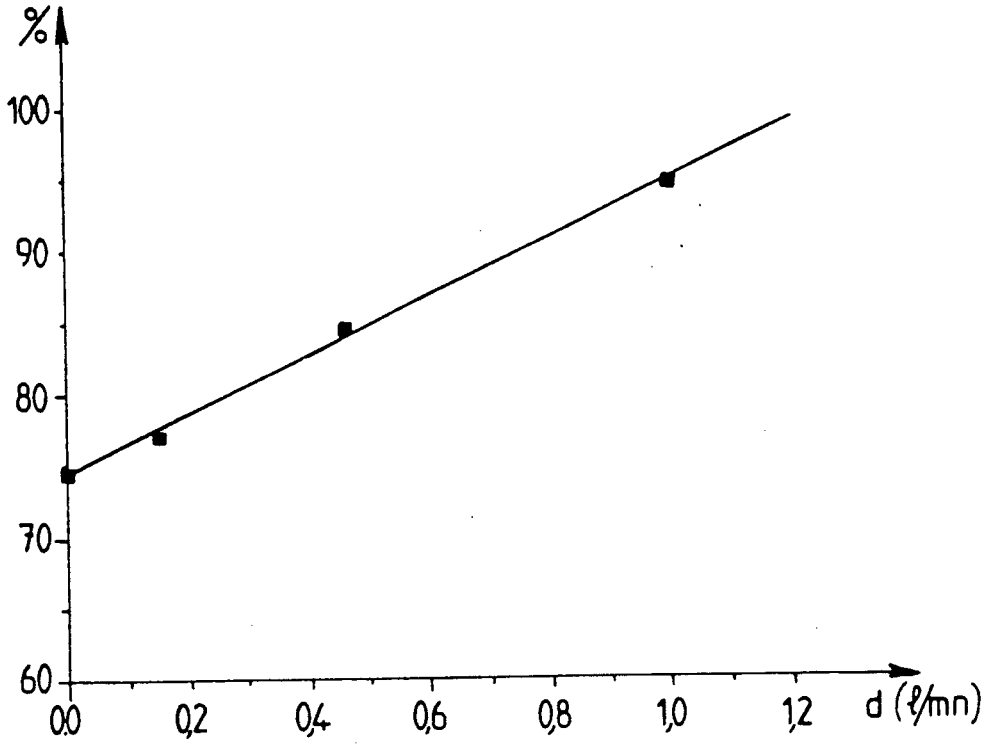
FIG. 2 shows a curve illustrating the influence of the flow rate of methane upon the cracking rate, d(l/mn) meaning the flow rate of $CH_4$ and % meaning the cracking rate.

The results of examples 1 to 4 are listed in the following table and FIG. 2 shows the evolution of the cracking rate versus the methane flow rate.

TABLE

| | Products (g)/100 g cracked | | | | | | | | | | | |
|---|---|---|---|---|---|---|---|---|---|---|---|---|
| Examples | Methane | CH + CH | acethylene | propane | propylene | butane | CH | C | C | C | C—C | cracking rate (%) |
| 1 | 25.44 | 35.96 | 2.92 | 0.64 | 18.32 | 0.41 | 8.11 | 4.54 | 1.01 | 1.16 | 2.58 | 94.73 |
| 2 | 11.82 | 41.94 | 0.59 | 0.94 | 21.33 | 0 | 10.07 | 3.86 | 1.84 | 1.35 | 6.26 | 84.49 |
| 3 | 9.56 | 39.56 | 1.12 | 0.69 | 19.38 | 0.41 | 10.01 | 3.61 | 2.75 | 2.85 | 10.05 | 76.94 |
| 4 | 8.34 | 36.66 | 0.22 | 0.68 | 18.50 | 0.35 | 8.30 | 4.76 | 5 | 4.1 | 13.08 | 74.60 |

As appears from the above table and from FIG. 2 it is seen that the introduction of methane promotes the cracking rate. As to the products from the reaction ethylene, propylene and butane are essentially obtained.

Moreover the method and the device according to the present invention allow a strict control of the temperature in the cracking zone through the combined effects of the electric power supplied to the plasma, of the plasma injection angle, of the flow rate of the heavy hydrocarbons and of the flow rate of the fluidizing gases.

It should be understood that the invention is not at all limited to the embodiments described and illustrated which have been given by way of examples only.

It should also be understood that the plasma used may be generated in any manner whatsoever in particular by a blown or transferred electric arc or also by induction.

What is claimed is:

1. A method of cracking a batch of heavy hydrocarbons into lighter hydrocarbons in a reaction chamber, comprising steps of:

providing in a reaction chamber a fluidized bed of particles by a fluidizing gaseous stream;

feeding a plasma jet comprising argon into said reaction chamber, said jet being directed towards a portion of said fluidized bed to create a zone of higher temperature;

feeding a batch of heavy hydrocarbons to be cracked into a portion of said fluidized bed remote from said plasma jet, said remote portion of said fluidized bed comprising a zone of lower temperature;

feeding a light alkane into the zone of higher temperature to produce free radicals for carrying out the cracking of said heavy hydrocarbons within said zone of lower temperature, said fluidized bed effecting a quenching of the reaction medium and catalyzing the cracking; and discharging the products thus obtained downstream of the zone of lower temperature.

2. A method according to claim 1, wherein the plasma is introduced at the periphery of the fluidized bed.

3. A method according to claim 2, wherein the heavy hydrocarbons and the plasma are introduced on opposite sides of the fluidized bed.

4. A method according to claim 1, further comprising imposing a predetermined residence time on the products obtained in a zone downstream of said lower temperature zone.

5. A method according to claim 1, wherein the flow rate of the fluidizing gaseous stream is such that said bed of particles is properly fluidized.

6. A method according to claim 5, wherein the fluidized gaseous stream comprises argon and hydrogen.

7. A method according to claim 1, wherein the plasma comprises at least 80% by volume of argon.

8. A method according to claim 7, wherein the plasma contains hydrogen.

9. A method according to claim 1, wherein the reaction zone of higher temperature is at a temperature lying between about 5,000° C. and 1,000° C.

10. A method according to claim 1, wherein the zone of lower temperature is at a temperature lying between about 900° C. and 500° C.

11. A method according to claim 1, wherein methane is fed into the reaction zone the temperature of which is lying between about 5,000° C. and 1,000° C.

12. A method according to claim 10, wherein the batch of heavy hydrocarbons is fed into a portion of the fluidized bed having a temperature between about 900° C. and 500° C.

13. A method according to claim 1, wherein the fluidizing gaseous stream is preheated upstream of the fluidized bed to a temperature between 50° C. and 500° C.

14. A method according to claim 1, further comprising preheating and vaporizing the batch of heavy hydrocarbons before feeding same into the reaction chamber.

15. A method according to claim 1, wherein the bed of particles comprises a refractory material selected from the group consisting of oxides, carbides, nitrides and borides.

16. A method according to claim 15, wherein the particles have a catalytic effect.

17. A method according to claim 15, wherein the bed further comprises a catalyst.

18. A method according to claim 1, wherein the cracking reaction is continued downstream of the zone of lower temperature of the fluidized bed within a zone having a temperature lying between about 650° C. and 550° C.

19. A method according to claim 1, wherein the light alkane is methane.

20. A method according to claim 13, wherein the fluidizing gas is preheated upstream of the fluidized bed to a temperature between 150° C. and 350° C.

21. A method of cracking a batch of heavy hydrocarbons into lighter hydrocarbons in a reaction chamber, comprising steps of:

providing in a reaction chamber a fluidized bed of particles by a fluidizing gaseous stream;

feeding a plasma jet comprising argon into said reaction chamber, said jet being directed towards a portion of said fluidized bed to create a zone of higher temperature;

feeding a batch of heavy hydrocarbons into a portion of said fluidized bed remote from said plasma jet, said remote portion of said fluidized bed comprising a zone of lower temperature;

feeding a mixture of light alkanes into the zone of higher temperature to produce free radicals for carrying out the cracking of said heavy hydrocarbons within said zone of lower temperature, said fluidized bed effecting a quenching of the reaction medium and catalyzing the cracking; and discharging the products thus obtained downstream of the zone of lower temperature.

22. A method of cracking a batch of heavy hydrocarbons into lighter hydrocarbons in a reaction chamber, comprising steps of:

providing in a reaction chamber a catalytic fluidized bed of particles by a fluidizing gaseous stream;

feeding a plasma jet comprising argon into said reaction chamber, said jet being directed towards a portion of said fluidized bed to create a zone of higher temperature;

feeding a batch of heavy hydrocarbons into a portion of said fluidized bed remote from said plasma jet, said remote portion of said fluidized bed comprising a zone of lower temperature;

feeding a mixture of light alkanes into the zone of higher temperature to produce free radicals for carrying out the cracking of said heavy hydrocarbons within said zone of lower temperature, said fluidized bed effecting a quenching of the reaction medium and catalyzing the cracking; and discharging the products thus obtained downstream of the zone of lower temperature.

* * * * *

UNITED STATES PATENT AND TRADEMARK OFFICE

CERTIFICATE OF CORRECTION

PATENT NO. : 5,026,949

DATED : June 25, 1991

INVENTOR(S) : Jacques Amouroux et al

It is certified that error appears in the above-identified patent and that said Letters Patent is hereby corrected as shown below:

| Column | Line | |
|---|---|---|
| 2 | 62 | After "plasma" insert --can--. |
| 4 | 64 | Before "carrying" delete "the". |
| 5 | 9 | After "mixture" change "or" to --of--. |
| 6 | 15 | After "allowing" delete "to" and insert --the cracking reaction to be completed.-- |
| 6 | 16 | Delete entire line. |
| 6 | 54 | Change "725°" to --730°--. |
| 6 | 55 | Change "0.15 l/mn" to --0.46 l/mn--. |
| 6 | 65 | Delete "with a", second occurrence. |

Signed and Sealed this

Twelfth Day of January, 1993

*Attest:*

DOUGLAS B. COMER

*Attesting Officer*

*Acting Commissioner of Patents and Trademarks*